US006185785B1

(12) United States Patent
Kingston

(10) Patent No.: US 6,185,785 B1
(45) Date of Patent: Feb. 13, 2001

(54) BUBBLING BOTTLE DOOR HANDLE

(75) Inventor: Lee Kelvyn Kingston, Kellyville (AU)

(73) Assignee: The Coca-Cola Company, Atlanta, GA (US)

( * ) Notice: Under 35 U.S.C. 154(b), the term of this patent shall be extended for 0 days.

(21) Appl. No.: 09/406,895

(22) Filed: Sep. 28, 1999

(51) Int. Cl.[7] ..... E05B 1/00

(52) U.S. Cl. ..... 16/412; 16/110.1; 16/903; 40/406; 40/661.12; 312/234; D8/305

(58) Field of Search ..... 16/412, 110.1, 16/111.1, 903; 40/331, 406, 409, 661.12; 446/483; 49/460, 501; 312/234, 234.3, 332.1; D8/300, 303, 305

(56) References Cited

U.S. PATENT DOCUMENTS

D. 113,233 * 2/1939 Manning, Jr. ..... D8/305
3,024,555 * 3/1962 Abeles ..... 40/331
3,314,746 * 4/1967 Millar ..... 16/414
4,586,280 * 5/1986 Dane ..... 40/406
5,502,908 * 4/1996 Powell et al. ..... 40/409
5,771,615 6/1998 Welldon et al. ..... 40/406

* cited by examiner

*Primary Examiner*—Chuck Y. Mah
(74) *Attorney, Agent, or Firm*—Finnegan, Henderson, Farabow, Garrett & Dunner, L.L.P.

(57) ABSTRACT

A bubbling door handle system for a cooler. The door handle system includes a door handle fixedly attached to the cooler. The door handle has a substantially transparent exterior surrounding an internal chamber. A fluid is positioned within the chamber. An air pump is positioned about the cooler. The air pump is in communication with the chamber so as to introduce air into the fluid.

20 Claims, 5 Drawing Sheets

BUBBLING BOTTLE DOOR HANDLE

TECHNICAL FIELD

The present invention relates generally to a door handle, and relates more particularly to a fluid-filled, aerated door handle for use with a cooler.

BACKGROUND OF THE INVENTION

Sculpted door handles have been placed on coolers and refrigerators used to house beverages or other items in retail outlets and elsewhere. These sculpted handles add to the aesthetics of the cooler door. The sculpted handles also may increase the exposure of the beverages or other items offered for sale to the passing consumers, i.e., the handle may catch the consumer's eye. For example, it is known to replace a cooler door handle with a handle sculpted in the shape of the well-known contoured bottle of The Coca-Cola Company of Atlanta, Ga. The use of such a sculpted handle serves to draw attention to the cooler and the beverages or other products within the cooler.

One goal in the design of the sculpted handles is to make the handle appear as close as possible to the product it is simulating. In the case of the contoured bottle, the design goal would be to have the handle appear as close as possible to an actual bottle of a carbonated soft drink. To date, this has been accomplished with a metal or a composite door handle manufactured in the shape of the contoured bottle. The handle is then painted partially with a dark color to simulate the carbonated beverage and partially with a light color to simulate the top of the bottle. The trademarks or other types of source indicia of the manufacturer or the distributor are then added to the door handle. Although the handle may appear to be an actual bottle at a distance, a close inspection of the handle may reveal that the handle is a close simulation.

What is needed, therefore, is a door handle or a similar object that attracts the eye of a consumer and also simulates a product to the greatest extent possible. Such a simulation should be realistic and easy to operate, while being relatively inexpensive to provide.

SUMMARY OF THE INVENTION

The present invention thus provides a bubbling door handle system for a cooler. The door handle system includes a door handle fixedly attached to the cooler. The door handle has a substantially transparent exterior surrounding an internal chamber. A fluid is positioned within the chamber. An air pump is positioned about the cooler. The air pump is in communication with the chamber so as to introduce air into the fluid. The result is the simulation of an actual beverage positioned within the chamber of the door handle.

Specific embodiments of the present invention include the use of a door handle having a bottle shape. The door handle may be made from a thermoplastic material. The fluid may be an oil solution such as an iso-paraffin oil. The fluid may have coloring therein. An aerator may be positioned within the chamber in communication with the pump so as to provide air bubbles to the fluid. The pump may be diaphragm pump. The pump may have a flow rate of about two liters per minute. The door handle may be fixedly attached to the cooler by a number of mounts or by similar means.

The door handle system may further include a number of air passageways connecting the pump and the chamber. The fluid may partially fill the chamber such that the chamber includes a fluid portion and an air portion. One of the air passageways connects the fluid portion of the chamber and one of the air passageways connects the air portion of the chamber. The air passageways may form an open loop system or a closed loop system with the pump.

A further embodiment of the present invention provides for a cooler with a number of beverages positioned therein. The cooler includes a door with a door handle fixedly attached thereto for movement therewith. The door handle may be made from a substantially transparent material. The door handle may have an internal chamber with a fluid positioned therein. The cooler also may include an air pump. The air pump may be in communication with the fluid in the chamber so as to provide the fluid with the appearance of one of the beverages position within the cooler. The door handle may have a bottle shape. The fluid may have the appearance of a carbonated soft drink or a similar beverage.

A further embodiment of the present invention provides for a bubbling door handle. The door handle may have a semi-transparent chamber for holding liquids and a compressor for the circulation of gas. A liquid may partially fill the chamber. An aerator may be positioned inside the chamber in communication with the compressor so as to release bubbles into the liquid. The door handle also has an intake tube for carrying gas from the compressor to the aerator and a vent for the release of gas from the chamber. The vent may be situated so as to avoid contact with the liquid.

Other objects, features, and advantages of the present invention will become apparent upon review of the following detailed description of the preferred embodiments of the present invention when taken in conjunction with the drawings and the appended claims.

DETAILED DESCRIPTION OF THE INVENTION

Figure 1:
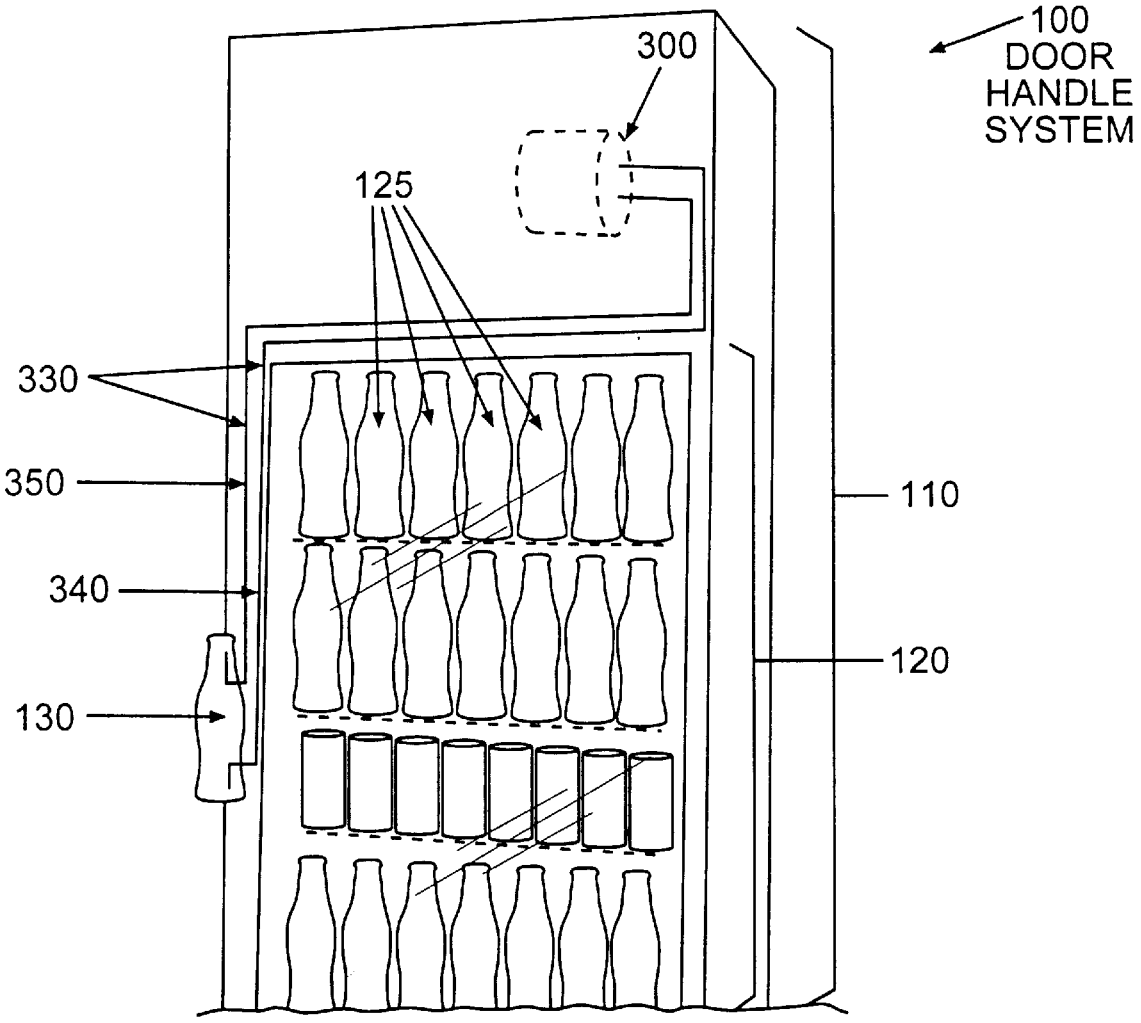
FIG. 1 is a perspective view of the bubbling door handle system of the present invention with the pump and the conduits shown in phantom lines.

Referring now in more detail to the drawings, in which like numerals refer to like parts throughout the several views, FIGS. 1–5 show a door handle system 100 of the present invention. The door handle system 100 preferably may be used with a refrigerator or a cooler 110 having a door 120. The cooler 110 may be largely of conventional design. The cooler door 120 may swing open, slide open, or open in any convenient fashion. The cooler door 120 may be transparent in whole or in part. The cooler 110 preferably has a number of products 125 placed therein that are offered for sale. The products 125 may be carbonated soft drinks or any kind of refrigerated beverages, foods, or other items.

This invention is preferably implemented as a bottle-shaped refrigerator door handle 130. The shape of the door handle 130 will typically mirror the shape of the beverage bottles or other products 125 housed within the cooler 110.

The door handle 130, however, may take any convenient shape. The door handle 130 may be made out of a transparent or semi-transparent thermoplastic material or any similar types of transparent or semi-transparent materials. The door handle 130 may be made by injection molding or other conventional types of manufacturing techniques. The door handle 130 may be e made from two halves that are welded together or otherwise fixedly joined.

The door handle 130 may be largely hollow with an interior chamber 140. A fluid 150 may partially fill the chamber 140. The fluid 150 fills a fluid portion 160 of the chamber 140 so as to leave an air portion 170 of the chamber 140. The fluid 150 may be a colored oil solution, such as an isoparaffin oil. Water or any other type of liquid also may be used. The fluid 150 may have an anti-fungal agent added thereto. The fluid 150 may be colored so as to match the color of the beverage desired to be simulated. For example, a dark brown color may be used to simulate a typical cola beverage. Other colors may be used to simulate, for example, noncarbonated beverages, beer, milk, or other types of fluids. A foaming agent also may be added as needed.

The door handle 130 also may have an aerator 180 positioned within the chamber 140. The aerator 180 may be largely of conventional design. The aerator 180 releases air into the fluid 150 as is known to those skilled in the art. The aerator 180 is a "sprinkler" or a "bubbler" device similar to an aquarium air "stone". Specifically, the aerator 180 releases air bubbles 190 that rise to the top and break at the surface of the fluid 150 so as to simulate a carbonated soft drink or other type of beverage. The aerator 180 may be made out of a sintered phosphor bronze or similar materials. The aerator 180 also may include sintered glass beads or similar materials.

The door handle 130 also may include a bottle inlet 200 and a bottle outlet 210. The bottle inlet 200 may be positioned in communication with the fluid portion 160 of the chamber 140 while the bottle outlet 210 may be positioned in communication with the air portion 170 of the chamber 140. The aerator 180 may be in communication with the bottle linlet 200 via a bottle line 220. The bottle line 220 may be any type of substantially air impermeable tubing.

Figure 2:
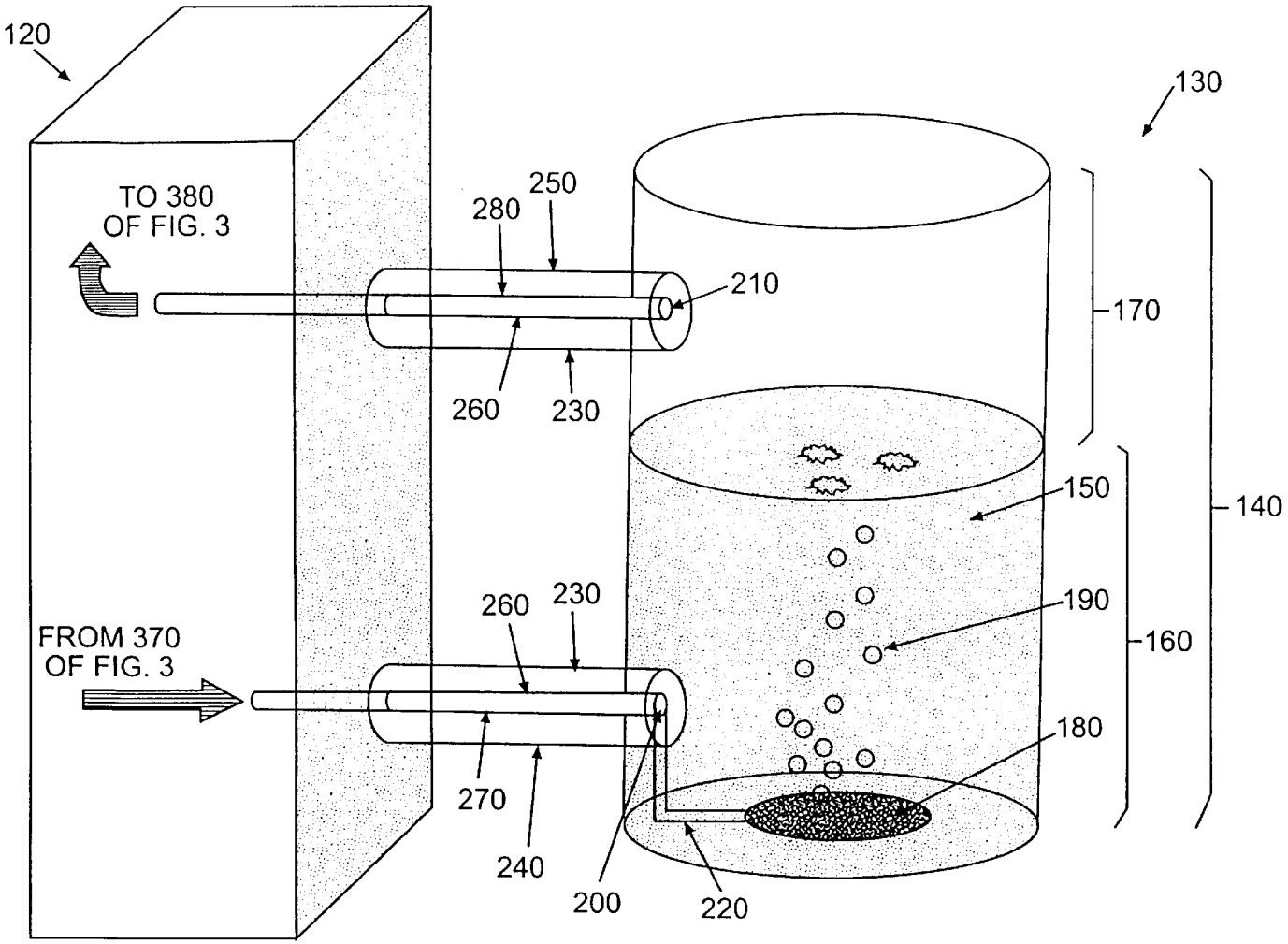
FIG. 2 shows a fluid-filled, semi-transparent door handle of the present invention having an aerator for creating bubbles.

The door handle 130 may be fixedly attached to the cooler door 120 by one or more mounts 230. These mounts 230 may be separate elements that are fixedly attached to the door handle 130 or the mounts 230 and the door handle 130 may be an integral element. The mounts 230 also may be made from a thermoplastic material in an injection molding process or by any other type of conventional materials and methods. In FIG. 2, two mounts 230 are shown, a first mount 240 and a second mount 250. Any number of mounts 230, however, may be used. The mounts 230 may each have an air passageway 260 therein in communication with the chamber 140 of the door handle 130. Specifically, the first mount 240 may have a first passageway 270 therein in communication with the chamber 140 via the bottle inlet 200 and the second mount 250 may have a second passageway 280 therein in communication with the chamber 140 via the bottle outlet 210.

Figure 3:
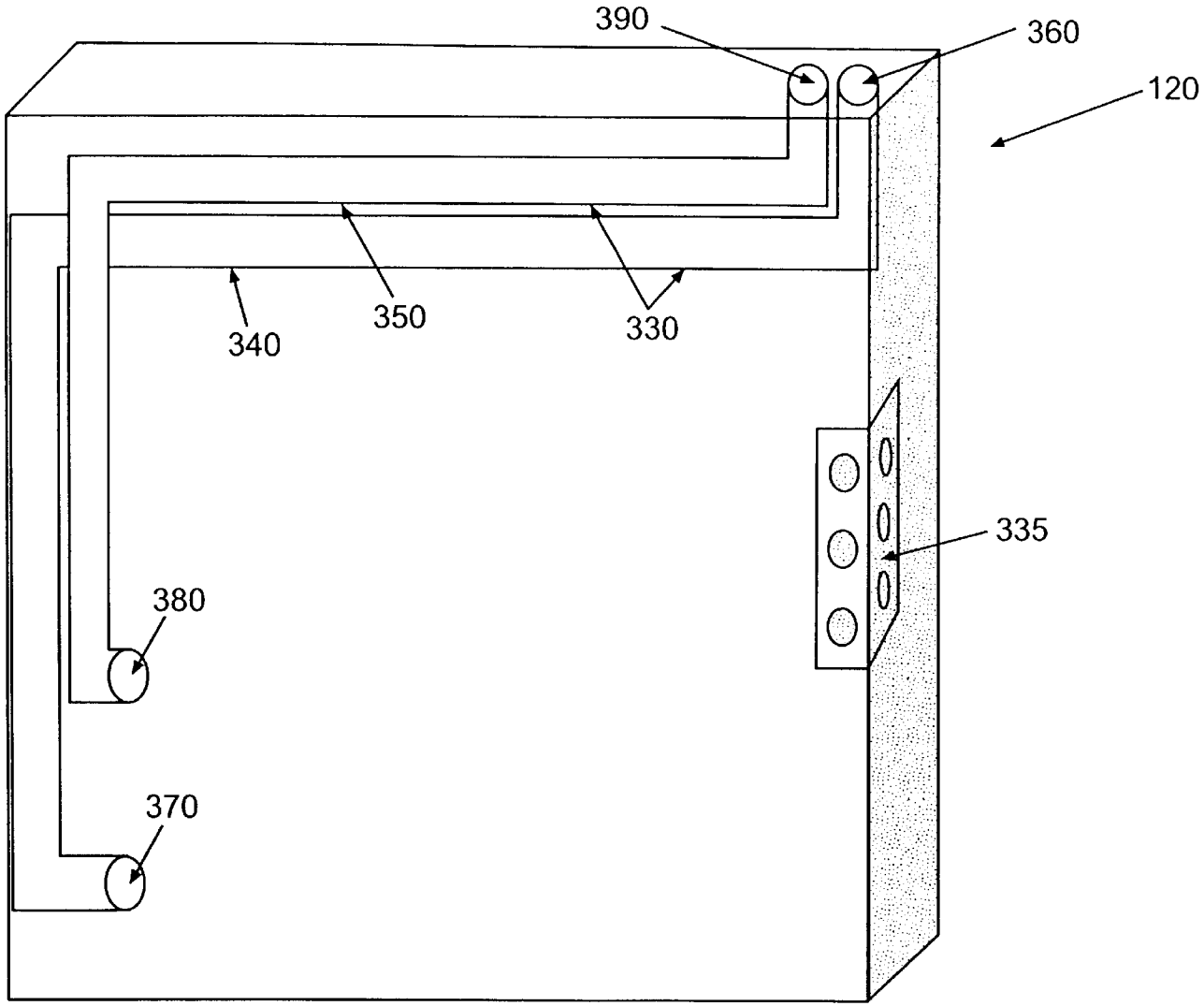
FIG. 3 shows a door that has a number of hollow channels therein.
Figure 4:
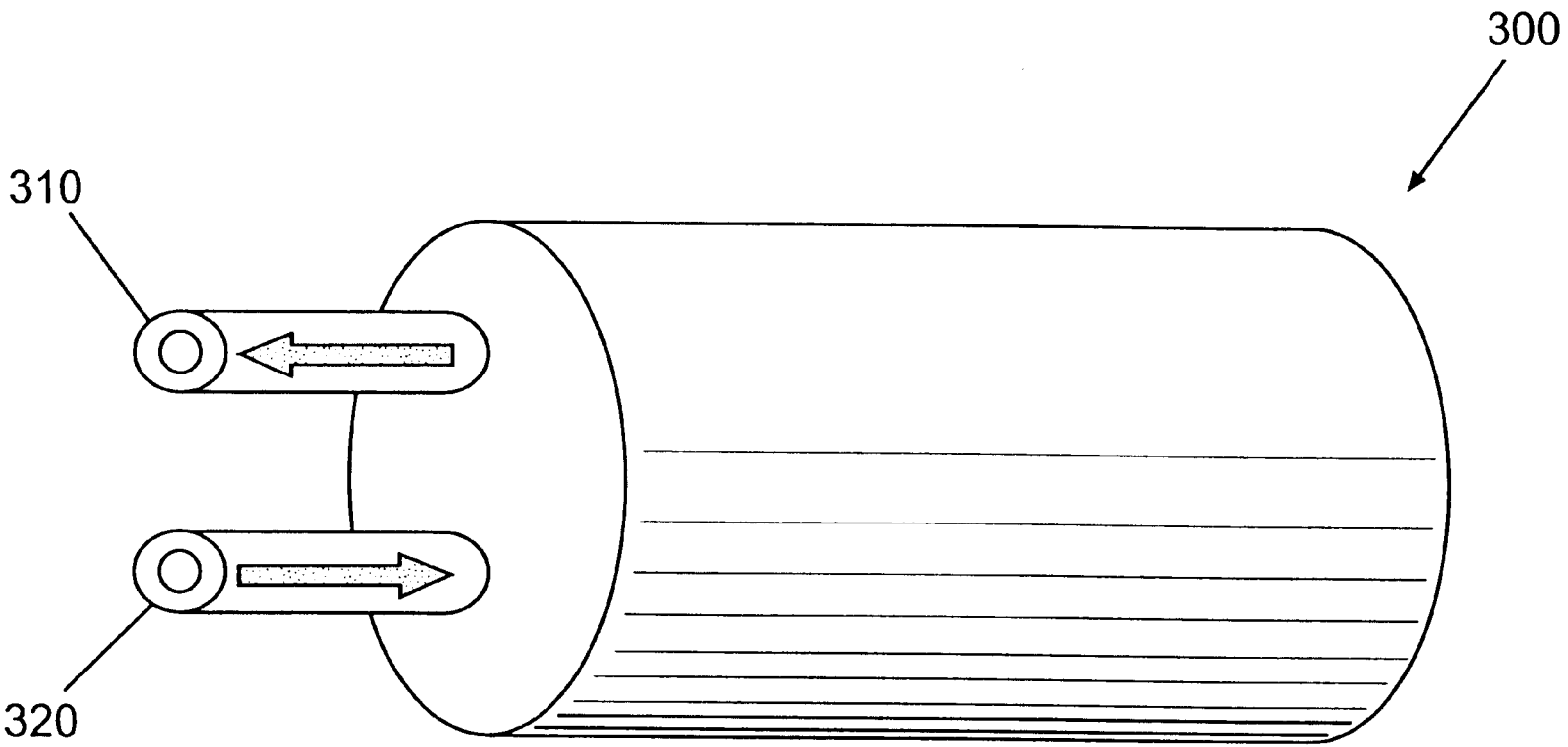
FIG. 4 shows a typical pump with an intake port for receiving gases and an exit vent for expelling gases.
Figure 5:
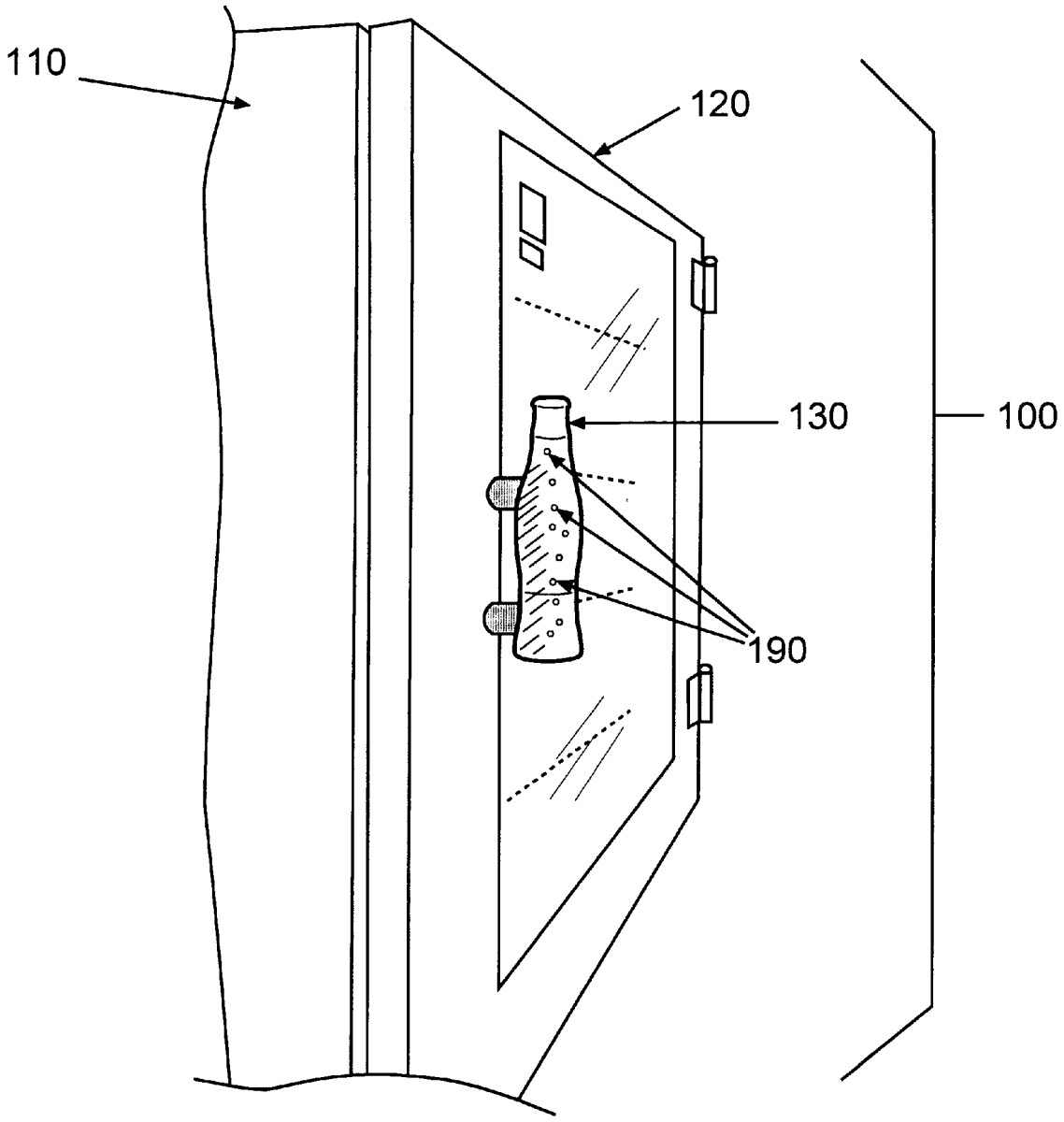
FIG. 5 is a perspective view of the door handle of the present invention on a conventional cooler.

As is shown in FIGS. 3 and 4, the door handle system 100 may include a pump 300 in communication with the door handle 130. The pump 300 may be a conventional diaphragm pump or any other type of air compressor. The pump 300 may be similar to a conventional aquarium air pump. The pump 300 may have a flow rate of about two liters per minute, although great variations in the flow rate may be accommodated. The operating pressure of the pump 300 may be about three to four psi (about 0.21 $Kgf/cm^2$ to about 0.28 $Kgf/cm^2$), also with great variations therein to be accommodated. The pump 300 generally includes an exit vent 310 and an entrance vent 320. A preferred air pump 300 is manufactured by Tetra/Second Nature, Inc. of the United States and sold under the name "Whisper 300" or by Yagami, Inc. of Japan and sold under the name "SP290". The pump 300 may be positioned within or adjacent to the cooler 110 or in any other convenient location. The pump 300 may be operated by a conventional electrical source. The pump 300 may need to be modified to accept an air return line in addition to an air discharge line.

The pump 300 may be in communication with the door handle 130 via one or more conduits 330. In this example, a first conduit 340 and a second conduit 350 are used. The conduits 330 may extend through the cooler 110 and the door 120. The conduits 330 may extend adjacent to the hinge mechanism 335 of the door 120. The conduits 330 may be any type of conventional, substantially air impermeable tubing. The first conduit 340 has a first air inlet 360 and a first air outlet 370. The second conduit 350 has a second air inlet 380 and a second air outlet 390. The first air inlet 360 of the first conduit 340 and the second air outlet 390 of the second conduit 350 are positioned near the pump 300 while the first air outlet 370 of the first conduit 340 and the second air inlet 380 of the second conduit 350 are positioned near the door handle 130.

The present invention may be implemented as a closed loop system, in which the air is recirculated, or as an openloop system. In a closed loop system, air is delivered from the exit vent 310 of the pump 300 (FIG. 4) to the first air inlet 360 of the first conduit 340. The first conduit 340 may extend through the door 120 of the cooler 100 to the first air outlet 370. The first air outlet 370 is in communication with the first passageway 270 of the first mount 240. The first passageway 270 is in communication with the aerator 180 of the door handle 130 via the bottle inlet 200 and the bottle line 220. The air is then released into the fluid 150 via the aerator 180. The air bubbles 190 then rise through the fluid 150 to the air portion 170 of the chamber 140.

After rising through the fluid 150 and into the air portion 170 of the chamber 140, the air is forced out of the chamber 140 via the bottle outlet 210 back towards the pump 300. The bottle outlet 210 is in communication with the second passageway 280 within the second mount 250. The second passageway 280 is in communication with the second conduit 350 positioned within the door 120 of the cooler 110 via the second air inlet 380. The air travels through the second conduit 350 and exits via the second air outlet 390. The second air outlet 390 is in communication with the entrance vent 320 of the pump 300. The air is then forced through the pump 300 so as to repeat the cycle. This closed loop design minimizing fluid loss due to, for example, foaming or evaporation.

As an alternative, an open loop pump system also may be used. Specifically, the entrance vent 320 of the pump 300 may be accessible to the atmosphere. Likewise, the second conduit 350 also may be vented to the atmosphere. In fact, the outgoing air may vent anywhere down stream of the door handle 130. Preferably, the second conduit 350 is vented at a location above the door handle 130. The air also may be vented directly through the air portion 170 of the door handle 130.

The door handle system 100 of the present invention thus provides a door handle that closely simulates an actual bottle with a carbonated beverage therein. Specifically, the door handle 130 is largely transparent and filled with the colored fluid 150. The fluid 150 has the appearance of being an actual carbonated beverage because of the air bubbles 190 rising therein. The combination of the fluid 150 and the bubbles 190 serves to catch the eye of the consumer and encourages the purchase of an actual carbonated beverage or other product offered for sale within the cooler 110.

It should be apparent that the foregoing description relates only to the preferred embodiments of the present invention and that numerous changes can be made herein without departing from the spirit and scope of the invention as defined by the following claims. Specifically, the scope of the present invention is defined by the following claims rather than the foregoing description.

What is claimed is:

1. A bubbling door handle system for a cooler, comprising:

a door handle adapted to be fixedly attached to said cooler;

said door handle comprising a substantially transparent exterior surrounding an internal chamber;

a fluid positioned within said chamber; and an air pump adapted to be positioned about said cooler;

said air pump in communication with said chamber so as to introduce air into said fluid.

2. The bubbling door handle system of claim 1, wherein said door handle comprises a bottle shape.

3. The bubbling door handle system of claim 1, wherein said door handle comprises a thermoplastic.

4. The bubbling door handle system of claim 1, wherein said fluid comprises an oil solution.

5. The bubbling door handle system of claim 4, wherein said oil solution comprises an iso-paraffin oil.

6. The bubbling door handle system of claim 1, wherein said fluid comprises coloring.

7. The bubbling door handle system of claim 1, further comprising an aerator positioned within said chamber in communication with said pump.

8. The bubbling door handle system of claim 1, wherein said pump comprises diaphragm pump.

9. The bubbling door handle system of claim 1, wherein said pump comprises a flow rate of about two liters per minute.

10. The bubbling door handle of claim 1, wherein said door handle comprises a plurality of mounts such that said door handle is adapted to be fixedly attached to said cooler.

11. The bubbling door handle of claim 1, further comprising a plurality of air passageways connecting said pump and said chamber.

12. The bubbling door handle system of claim 11, wherein said fluid partially fills said chamber.

13. The bubbling door handle system of claim 12, wherein said chamber comprises a fluid portion and an air portion.

14. The bubbling door handle of claim 13, wherein one of said plurality of air passageways connects said fluid portion of said chamber and one of said plurality of air passageways connects said air portion of said chamber.

15. The bubbling door handle system of claim 11, wherein said plurality of air passageways comprises an open loop system with said pump.

16. The bubbling door handle system of claim 11, wherein said plurality of air passageways comprises a closed loop system with said pump.

17. A cooler with a plurality of beverages positioned therein, said cooler comprising:

a door;

a door handle fixedly attached to said door for movement therewith;

said door handle comprising a substantially transparent material;

said door handle comprising an internal chamber;

a fluid positioned within said chamber; and an air pump positioned about said cooler;

said air pump in communication with said fluid in said chamber so as to provide said fluid with an appearance of one of said plurality of beverages.

18. The cooler of claim 17, wherein said door handle comprises a bottle shape.

19. The cooler of claim 18, wherein said fluid comprises an appearance of a carbonated soft drink.

20. A bubbling door handle, comprising:

a semi-transparent chamber for holding liquids;

a compressor for the circulation of gas, said compressor located external to said chamber;

a liquid contained in said chamber, said liquid partially filling said chamber;

an aerator in communication with said compressor so as to release bubbles into said liquid;

an intake tube for carrying gas from said compressor to said aerator; and a vent for releasing gas from said chamber, said vent situated so as to avoid contact with said liquid.

* * * * *